US008613277B2

(12) United States Patent
Hall, Jr. et al.

(10) Patent No.: US 8,613,277 B2
(45) Date of Patent: Dec. 24, 2013

(54) OUTDOOR FLAME HEATER

(75) Inventors: Edwin L. Hall, Jr., Amelia Island, FL (US); Hampton Hollis Tanner, Amelia Island, FL (US)

(73) Assignee: Well traveled livings, Amelia Island, FL (US)

( * ) Notice: Subject to any disclaimer, the term of this patent is extended or adjusted under 35 U.S.C. 154(b) by 954 days.

(21) Appl. No.: 12/724,397

(22) Filed: Mar. 15, 2010

(65) Prior Publication Data

US 2010/0236544 A1 Sep. 23, 2010

Related U.S. Application Data

(60) Provisional application No. 61/202,604, filed on Mar. 17, 2009, provisional application No. 61/202,618, filed on Mar. 18, 2009.

(51) Int. Cl.
*F24C 3/04* (2006.01)

(52) U.S. Cl.
USPC ..... 126/92 B; 126/85 R

(58) Field of Classification Search
USPC ..... 126/85 R, 92 B, 208; 431/12, 126; 211/120.3, 186, 187, 189, 190
See application file for complete search history.

(56) References Cited

U.S. PATENT DOCUMENTS

| | | | | | |
|---|---|---|---|---|---|
| 1,536,613 | A * | 5/1925 | Lyons | 122/18.31 |
| 2,277,302 | A * | 3/1942 | Chenette | 280/659 |
| 3,043,116 | A * | 7/1962 | Fuller | 62/244 |
| 3,851,601 | A * | 12/1974 | Davis | 108/158.11 |
| 4,967,916 | A * | 11/1990 | Handler et al. | 211/187 |
| 6,050,177 | A * | 4/2000 | Lassig, Jr. | 99/340 |
| D471,622 | S * | 3/2003 | Bossler | D23/335 |
| D471,967 | S * | 3/2003 | Bossler | D23/328 |
| 6,745,759 | B2 * | 6/2004 | Bossler | 126/92 B |
| 6,799,660 | B1 * | 10/2004 | Crawford | 182/200 |
| 7,175,424 | B2 * | 2/2007 | Frink et al. | 431/126 |
| D563,537 | S * | 3/2008 | McColgin et al. | D23/317 |
| D567,916 | S * | 4/2008 | McColgin et al. | D23/317 |
| 2003/0029439 | A1 * | 2/2003 | Bossler | 126/92 B |
| 2003/0056783 | A1 * | 3/2003 | Bossler | 126/92 AC |
| 2003/0085191 | A1 * | 5/2003 | Nakajima | 211/186 |
| 2006/0163438 | A1 * | 7/2006 | Wojotowicz et al. | 248/300 |
| 2007/0034584 | A1 * | 2/2007 | Park | 211/187 |
| 2008/0152329 | A1 * | 6/2008 | Saunders et al. | 392/407 |
| 2011/0076627 | A1 * | 3/2011 | DiVentura | 431/12 |
| 2011/0162632 | A1 * | 7/2011 | DiVentura | 126/58 |

* cited by examiner

*Primary Examiner* — Steven B McAllister
*Assistant Examiner* — George R Blum
(74) *Attorney, Agent, or Firm* — Lau & Associates

(57) ABSTRACT

The present invention is a knock-down design of an outdoor heater. An outdoor heater without resorting to knock-down designs is heavy and bulky. It is costly to ship due to its sheer size and heavy weight. A knock-down design on the other hand resorts to innovative designs in using light weight components with structural reinforcements to increase load bearing capacities thus achieve the same effect as using heavier traditional materials. A knock-down design also resorts to innovative designs in reducing component size so as to occupy a small footprint for ease of packaging and shipment. Consequently, a knock-down design heater can be packaged in a footprint many times smaller than a full size heater and it weights much less than a traditional outdoor heater. It provides cost advantages in pre-sale shipment and general distribution, post-sale transportation convenience as well as ease of relocation during subsequent years of usage.

25 Claims, 19 Drawing Sheets

OUTDOOR FLAME HEATER

This non-provisional patent application hereby claims under 35 U.S.C. 119(e) the benefit of U.S. Provisional Patent Application No. 61/202,604 filed on Mar. 17, 2009 and U.S. Provisional Patent Application No. 61/202,618 filed on Mar. 18, 2009.

This non-provisional patent application hereby incorporates by reference U.S. Provisional Patent Application No. 61/202,604 filed on Mar. 17, 2009 and U.S. Provisional Patent Application No. 61/202,618 filed on Mar. 18, 2009.

BACKGROUND OF THE INVENTION

With the advancement of transportations and the proliferation of trade barriers among nations, goods from one country can be easily transported and sold to another country. Consumers worldwide benefit the most from this advancement and proliferation as foreign goods are no longer out-of-reach due to either the mere impracticality of shipping as well as exorbitant prices. Despite these developments, international or domestic shipping cost is still an inevitable overhead expense for goods sold in any country.

Shipping cost is determined by both weight and size. To reduce weight, there must be innovative designs that would minimize materials used yet provide proper structural integrity to render a product suitable for its intended use. To reduce volume, parts must be innovatively designed to occupy the smallest footprint possible for ease of packaging and transportation. Designing a product with shipping economy and ease of distribution in mind, the product would have a much higher market penetration power than a similar product not so designed.

The present invention is a rectangular shape flame heater and a pyramid shape flame heater. Both products are rather tall and bulky when fully assembled. The nature of a heater demands strong rigidity and high durability per safety and reliability expectations. For these reasons, traditional flame heaters are made by welding solid metallic parts together. They are therefore very heavy and bulky for shipping, distribution and relocation purposes.

To overcome these shortcomings, the present invention provides a knock-down design of a rectangular shape flame heater and a knock-down design of a pyramid shape flame heater. Before being fully assembled, parts of either heater occupy a space volume many times smaller than the space volume of a fully assembled heater. The pre-assembled compact size is ideal for economy of shipment and ease of distribution.

SUMMARY OF THE INVENTION

The first object of the present invention is to provide an outdoor rectangular shape flame heater.

The second object of the present invention is to provide an outdoor pyramid shape flame heater.

The third object of the present invention is to provide an outdoor rectangular shape flame heater that can be assembled and disassembled.

The fourth object of the present invention is to provide an outdoor pyramid shape flame heater that can be assembled and disassembled.

The fifth object of the present invention is to provide an outdoor rectangular shape flame heater with a knock-down design that fully meets structural rigidity requirements once fully assembled.

The sixth object of the present invention is to provide an outdoor pyramid shape flame heater with a knock-down design that fully meets structural rigidity requirements once fully assembled.

The seventh object of the present invention is to provide an outdoor rectangular shape flame heater with a knock-down design that can be disassembled and packed into a space many times smaller than the space occupied by a fully assembled heater.

The eighth object of the present invention is to provide an outdoor pyramid shape flame heater with a knock-down design that can be disassembled and packed into a space many times smaller than the space occupied by a fully assembled heater.

The ninth object of the present invention is to provide an outdoor rectangular shape flame heater with a knock-down design that is lighter in weight than a welded design.

The tenth object of the present invention is to provide an outdoor pyramid shape flame heater with a knock-down design that is lighter in weight than a welded design.

The eleventh object of the present invention is to provide an outdoor rectangular shape flame heater using one of a whole tube and a plurality of glass tubes to house burning flames.

The twelfth object of the present invention is to provide an outdoor pyramid shape flame heater using one of a whole tube and a plurality of glass tubes to house burning flames.

DETAIL DESCRIPTION OF THE INVENTION

Figure 1:
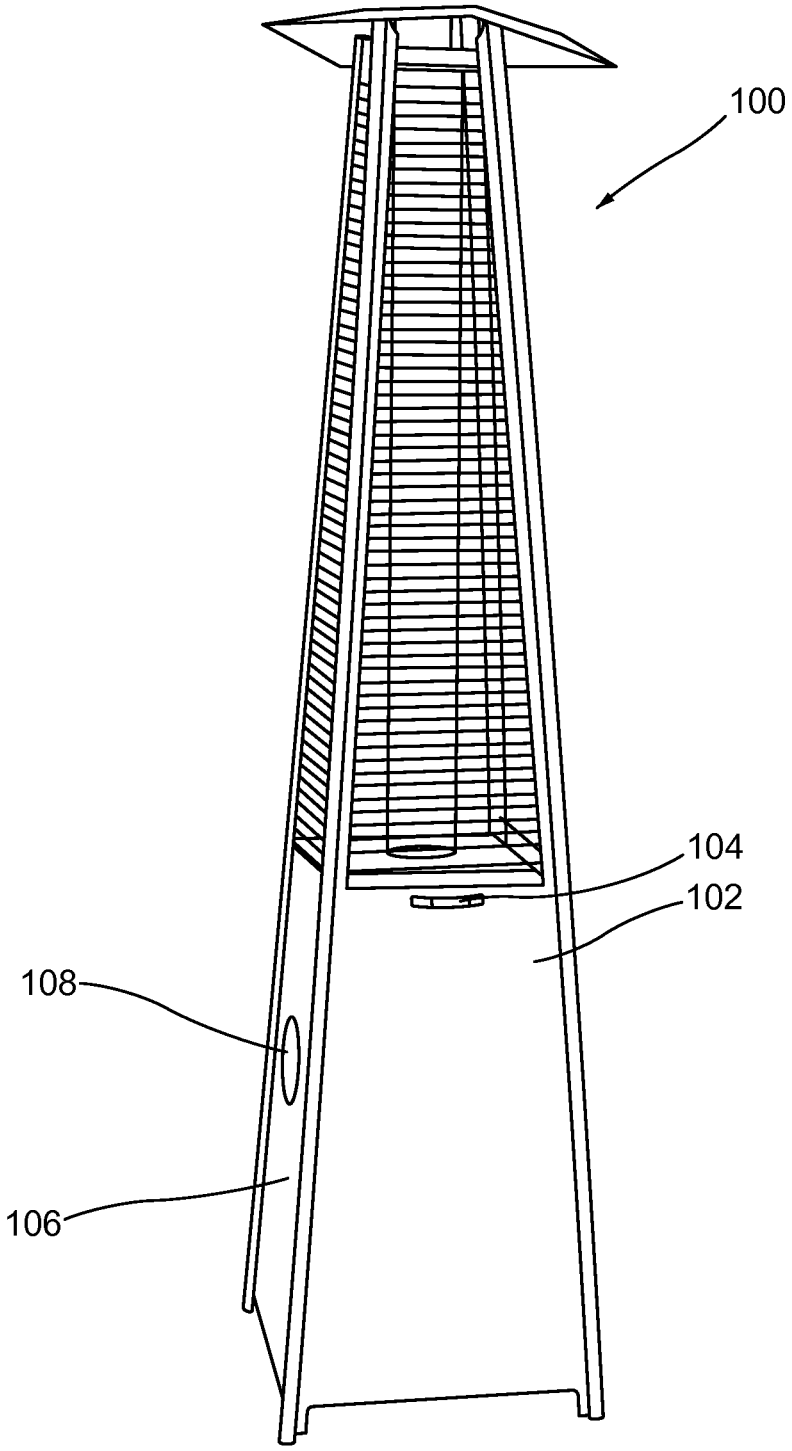
FIG. 1 is a front perspective view of a pyramid shape flame heater in a fully assembled state.

FIG. 1 shows a perspective view of a pyramid shape flame heater 100 in its fully assembled state. The front panel 102 with a handle 104 either in the form of a knob or a handle bar is used to open and close the front panel for the purpose of installing and removing combustible material such as liquid propane stored in a liquid propane (LP) tank.

The front panel may be removeably installed by a number of known means and in this case is removeably installed by a magnet along with a safety chain. The other three panels are not removeably installed as in the case of the front panel. Instead, they are permanently installed by a number of known means and in this case are by resorting to screws and pre-cut retaining tongue and slot. The removeably installed front panel and the three permanently installed side panels form an interior chamber to house the LP tank and other accessories.

A set of wheels 1702 may be installed underneath either one of the three permanently installed side panels but preferably on the back side panel opposite to the front panel 102. This is the most desirable location because when the pyramid shaped flame heater is tilted to engage the set of wheels to the ground for relocation, any LP tank or other accessories may be securely retained inside the interior chamber and would not inadvertently fall out or roll out of the chamber, which very well could happen if the set of wheels are installed underneath the front panel 102 or underneath either the left side panel or the right side panel of the heater.

As shown by way of an example is an opening 108 residing on a side panel 106. Opening 108 serves safety ventilation, ease of access and ease of observation purposes.

Figure 6:
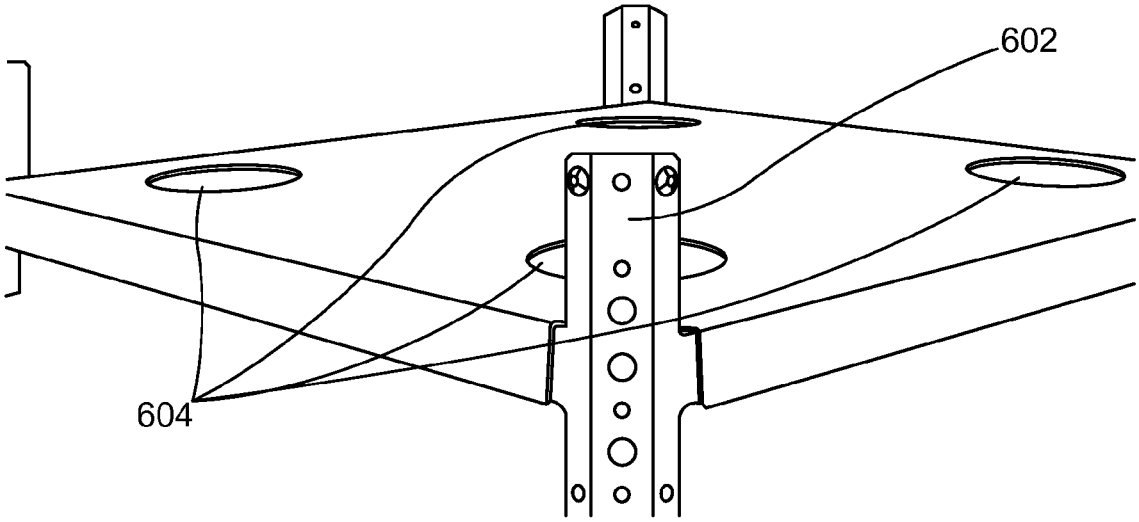
FIG. 6 is a perspective view of a lower plate featuring a low corner tab thereof.

FIG. 6 shows a number of holes 604 on a bottom plate 232. Due to height differences between opening 108 and holes 604, a difference in atmospheric pressure between those heights could create a natural vent path to dissipate any combustible gas from the interior chamber in case a leak occurs.

Figure 2:
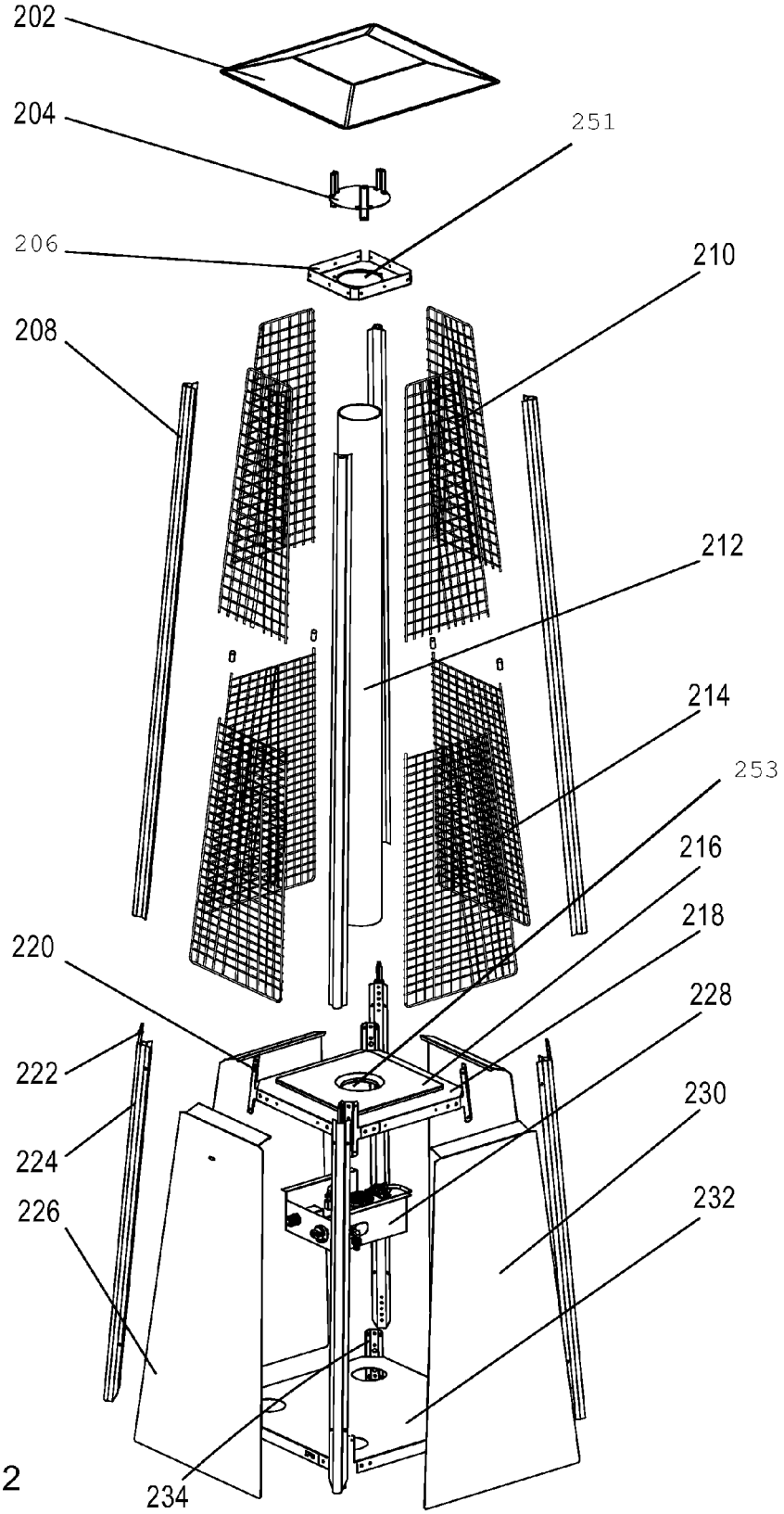
FIG. 2 is an exploded view of a pyramid shape flame heater.

FIG. 2 shows an exploded view of the pyramid shape flame heater. The exploded view shows the knock down design of the flame heater where a summing of the parts forms the whole and the parts can be packaged in a rather small foot print for ease of shipping and general transportation. As can be visually appreciated, the flame heater in its pre-assembled state may be packaged in a size many times small than the fully assembled heater.

Major components of the pyramid shape flame heater as shown in the exploded view include a reflector 202, a damper 204, an upper plate 206, a set of four upper support members 208 with an upper central hole 251, a set of four upper protection guards 210, a glass tube 212, a set of fours lower protection guards 214, a plate cover 216, a set of four connection stems 220 affixed to four corners of a middle plate 218 with a middle central hole 253, a set of four lower support members 224 each with a center-folded linear intermediate connecting piece 222, a front panel 226, a control box 228, a set of three side panels 230 and a bottom plate 232 where each corner thereof is a vertical connection stem 234.

The set of four upper support members 208 and the set of four lower support members 224 are the major components responsible for keeping the pyramid shape flame heater standing upright. Therefore, their load bearing capacity is of critical importance. Traditional supports may be made of heavy gage solid steel rods or hollow steel pipes. To minimize weight hence optimize shipping economy without sacrificing structural rigidity, metallic alloys or light metallic materials may be used. However, a special structural design is needed to reinforce its rigidity and ensure its weight bearing capacity.

Figure 3:
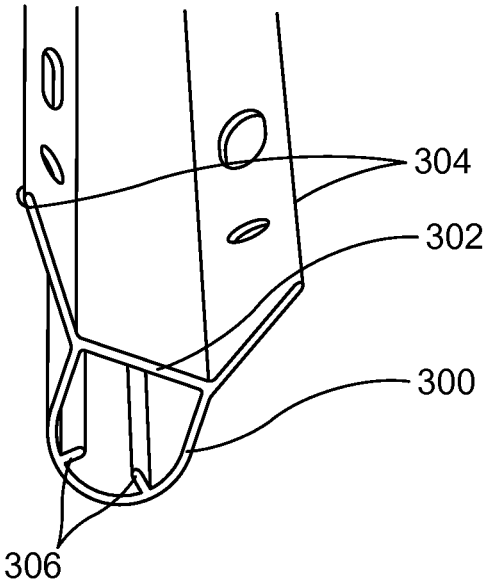
FIG. 3 is an end perspective view of a support member showing the structure of the support.

FIG. 3 shows the structural design of the support member, wherein half of an elongated oval shape tube 300 is budded against a flat wall 302 having two wings 304. Inside the elongated oval shape tube 300 is a pair of brackets 306 forming a pair of identical angular tracks therein opposite in orientation.

Figure 4:
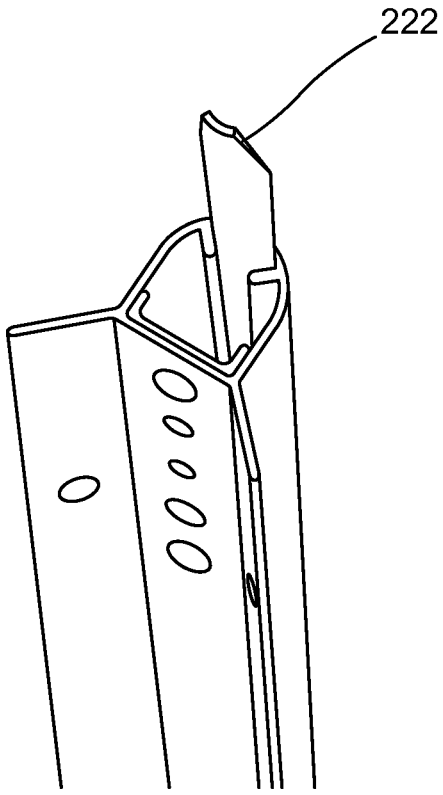
FIG. 4 is a perspective view where a center-bend linear tab is inserted into a pair of tracks.

FIG. 4 shows a center-folded linear intermediate connecting piece 222 with one end snugly fitted into the pair of identical angular tracks and anther end exposed. The center-fold design of the connecting piece 222 substantially increases the bend resistance thereof whether the bending force comes from front or back side of the connecting piece. This connecting piece design produces far superior results in bending resistance than a flat design. Hence, the load bearing capacity of the support members are accordingly increased.

Figure 5:
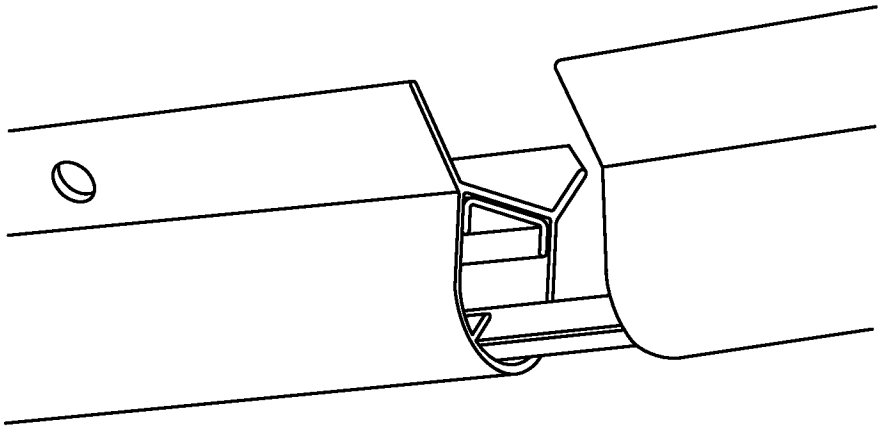
FIG. 5 is a perspective view where a center-bend linear tab inter-connects two support members.

FIG. 5 shows how an end of the upper support member 208 may be connected to an end of the lower support member 224 via the center-folded linear intermediate connecting piece 222.

Once the set of four upper support members 208 are correspondingly connected to the set of four lower support members 224 via a set of four center-fold linear intermediate connecting pieces 222, they serve as four pairs of end supports of the flame heater. The four pairs of end support members are held together by being affixed to an upper plate 206 on the top portion, a middle plate 218 on the mid portion, and a bottom plate 232 on the bottom portion.

Figure 7:
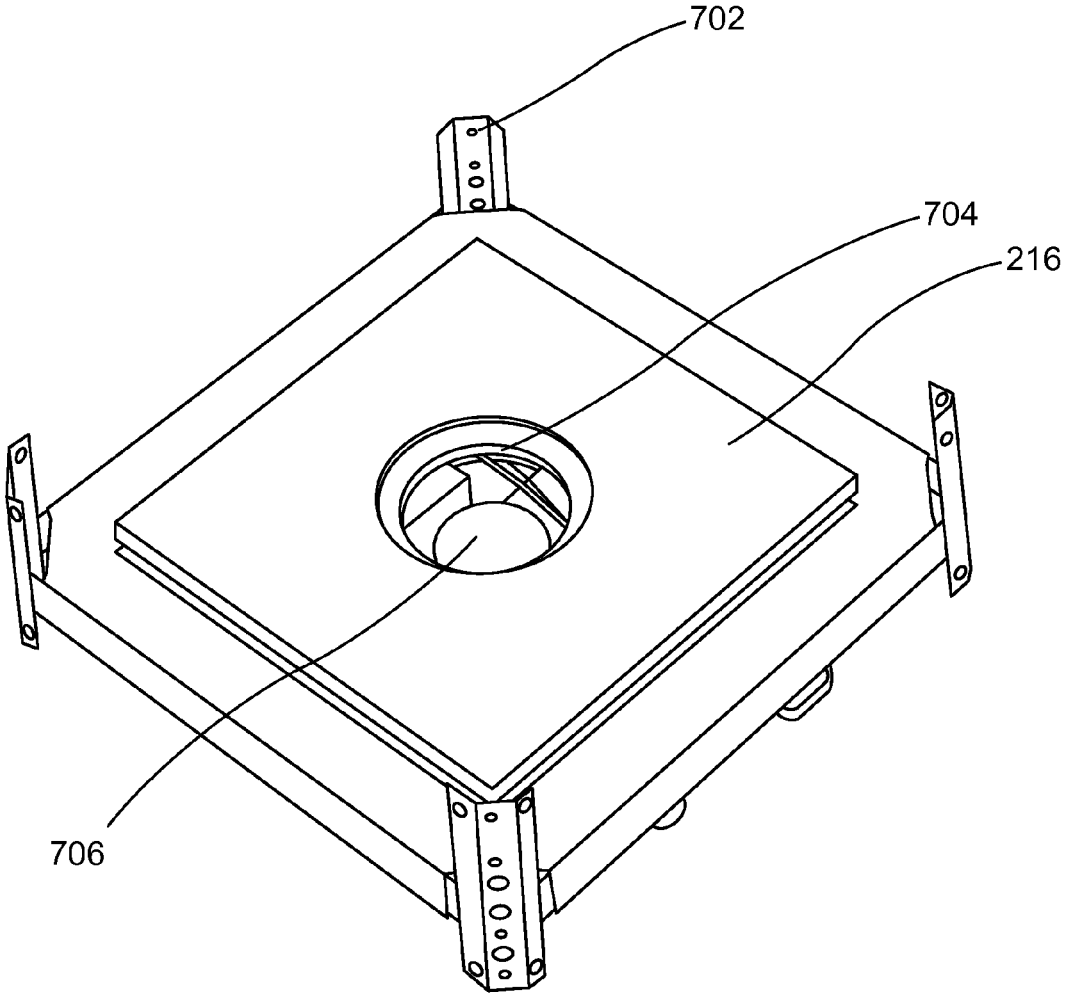
FIG. 7 is a top perspective view of a middle plate featuring a set of middle corner tabs thereof and a plate cover resting thereon.
Figure 9:
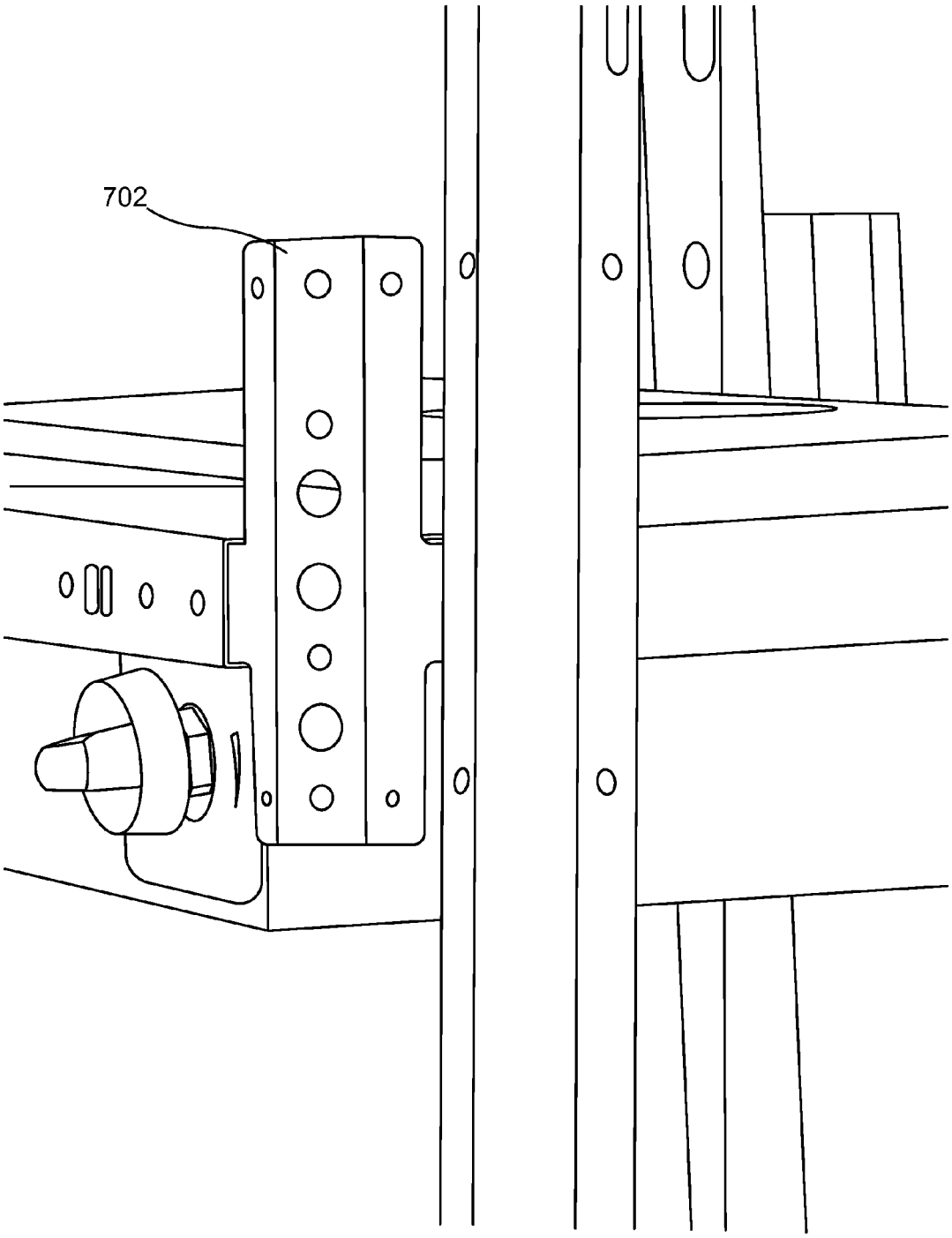
FIG. 9 is a view showing how a middle corner tab of a middle plate could custom fit to the interior of two connected support members with a flat wall with two wings design and be fastened by nuts and bolts through a set of pre-drill holes.

FIG. 6 shows a close-up view of the bottom plate 232 wherein each corner contains a bottom corner vertical connection tab 602 and FIG. 7 shows a close-up view of the middle plate 218 where each corner contains a mid corner vertical connection tab 702. Both tabs 602 and 702 have the same shape and general configuration as the flat wall 302 with two wings 304 so that each tab can be affixed to an end support member by retaining nuts and bolts through a set of commonly shared pre-drilled holes, for example as shown in FIGS. 3-4 and 9.

For the middle plate 218, in addition to interconnecting the upper support member 208 and the lower support member 224, the mid corner vertical connection tab 702 also reinforce the rigidity and lead bearing capacity of the connected members. By so reinforcing, it has successfully eliminated the weakest juncture which is usually where two members are connected.

Figure 10:
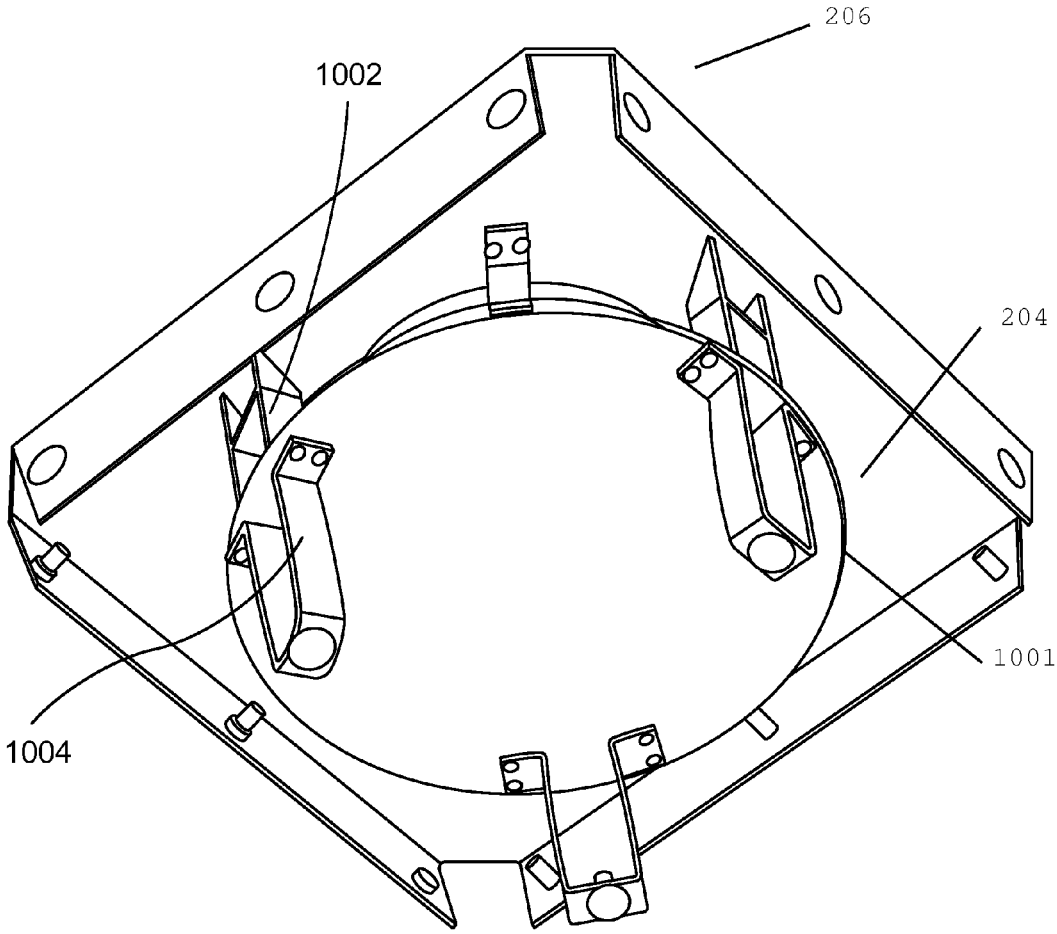
FIG. 10 is a top perspective view of an upper plate.

Corners of the upper plate 206 do not contain tabs similar to tabs 602 and 702. Instead, the corners are pre-cut as shown in FIG. 10 so that each would complement the general shape and configuration of the flat wall 302 with two wings 304 whereby each corner may be affixed to the upper support 208 by pre-drilled holes and suitable screws or nuts and bolts. This different arrangement for the upper plate 206 would not adversely affect the overall rigidity and load bearing capacity of the heater because little weight is bore at the top of the heater. Once the corner supports are correspondingly affixed to the upper plate 206, the middle plate 218 and the bottom plate 232, the core frame of the flame heater is successfully constructed.

Remaining parts to be assembled are internal parts and external parts. Internal parts to be installed include a control box 228 and a glass tube 212 or a plurality of glass tubes that can be co-jointed to form one tube structure. The glass tube 212 rests on the middle plate 218 throw a hole opening of plate cover 216 as shown in FIG. 7. The middle plate 218 contains a hole opening surrounding which is a circular retaining lip 704 protruding above a top surface of the middle plate 218. The diameter of this circular retaining lip 704 is slightly smaller than the interior diameter of the glass tube 212 so that the circular lip fits within the interior diameter of the glass tube and prevents the glass tube from sliding sideways. A rubber ring may be added in-between the glass tube 212 and the circular retaining lip 704 to serve as a cushion to prevent unintended breakage of the glass tube when the heater is relocated.

Figure 11:
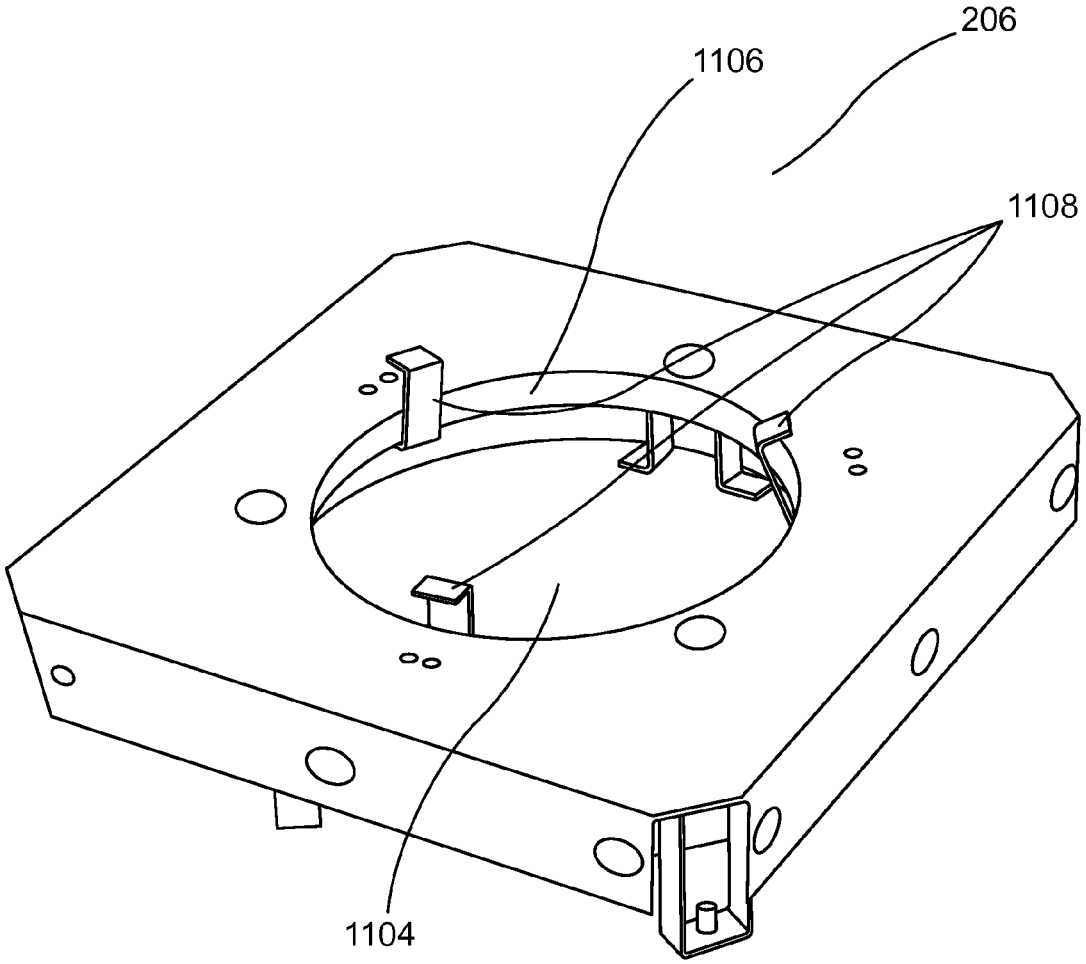
FIG. 11 is a bottom perspective view of an upper plate with each of the four corners pre-cut so as to be complimentarily fastened to a flat wall with two wings design of a support member.
Figure 12:
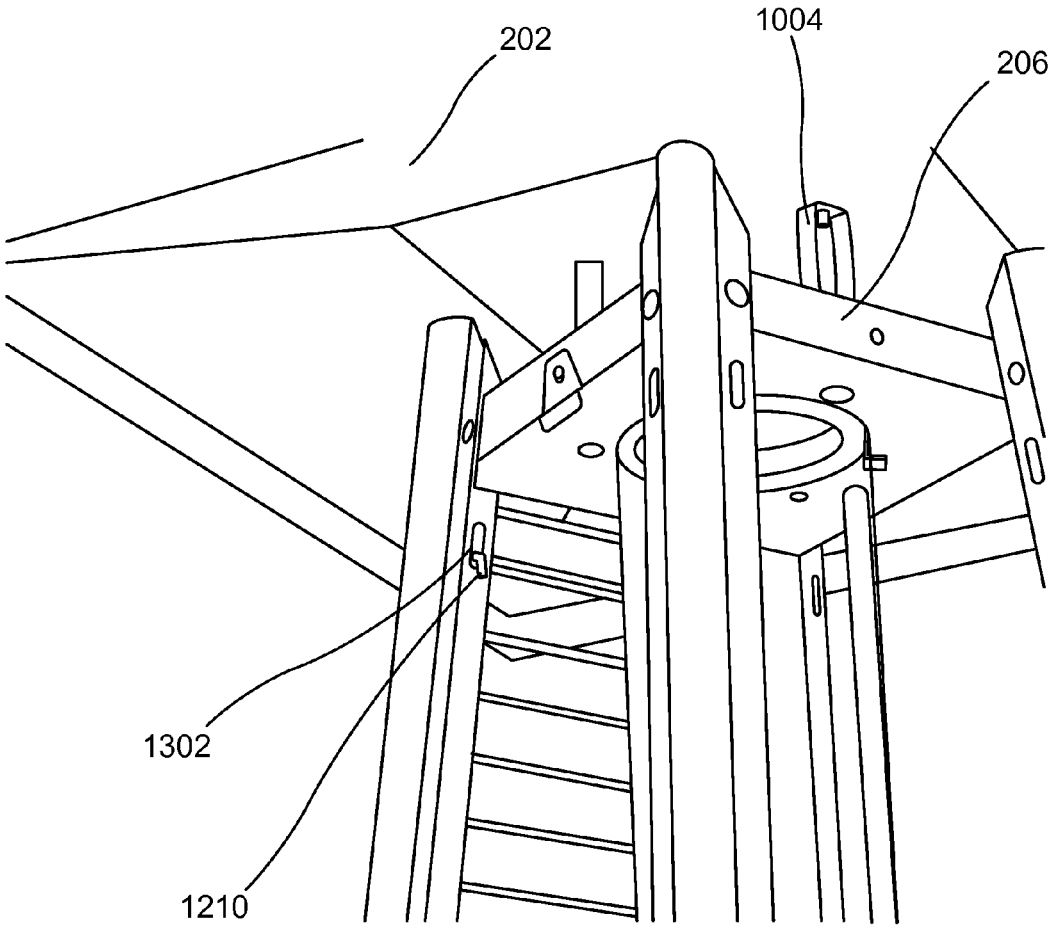
FIG. 12 shows how an upper protection guard is secured to a support member by using a hook to rest on a pre-cut oval elongated oval opening.

The top of the glass tube 212 is fitted into a circular opening 1104 of the upper plate 206, seated by a retaining lip 1106 protruding above a surface of the upper plate 208 and stabilized by a set of retaining clips 1108 as clearly shown in FIGS. 11 and 12.

Figure 8:
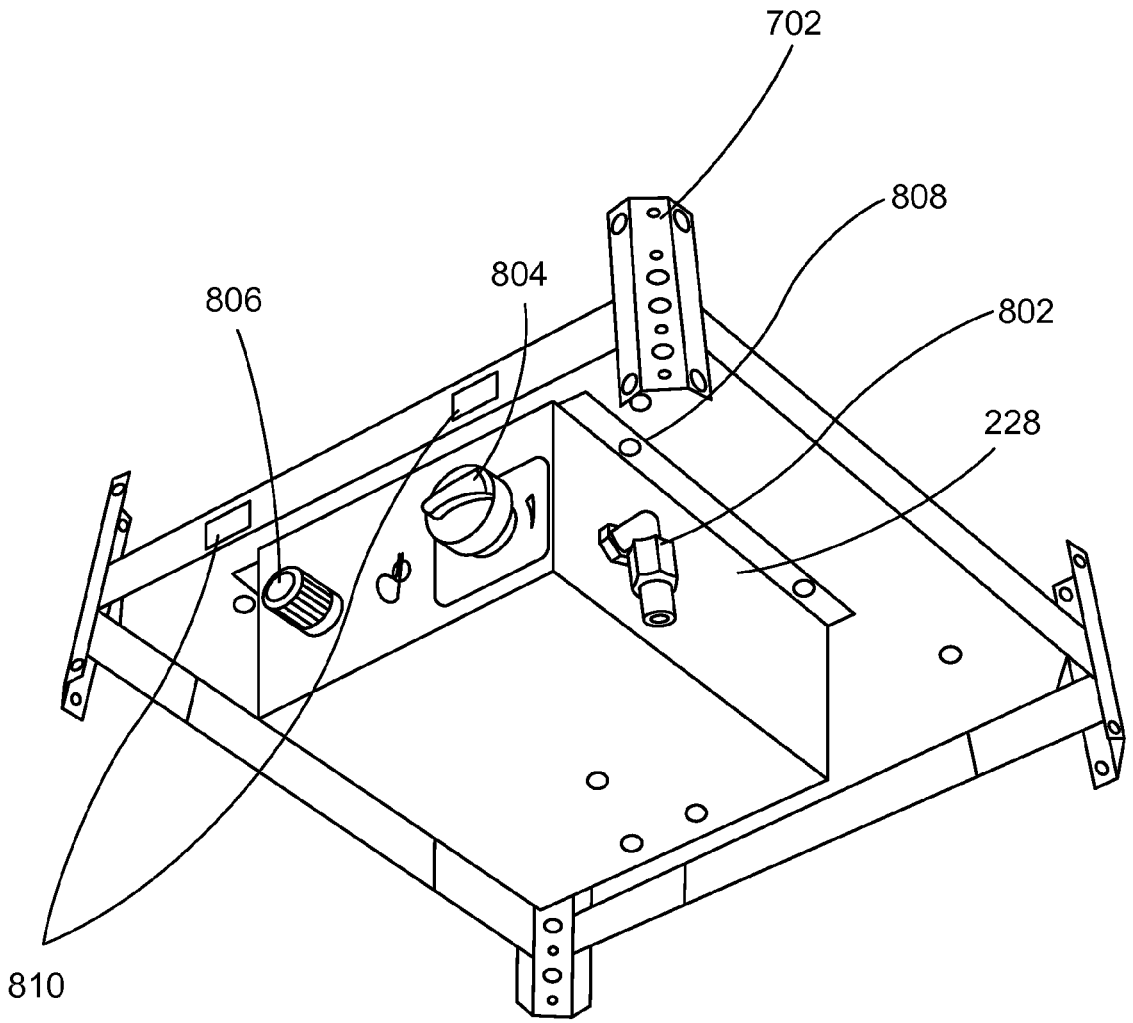
FIG. 8 is a bottom perspective view of a middle plate featuring a set of corner tabs thereon and a control box installed there-under.

The control box 228 as shown in FIG. 8 featuring an inlet orifice 802, a temperature control dial 804 and an ignition switch 806 is affixed underneath the middle plate 218 by a set of suitable screws or nuts and bolts through a set of pre-drilled holes. The inlet orifice 802 is used to connect to the LP tank via a proper connection hose. Residing on the top of the control box 228 is a gas flame outlet (or burner central hole) 706 whereby the a flame is ignited by the ignition switch 806 and the intensity of the flame is controlled by the temperature control dial 804.

External parts to be assembled are divided into upper portions and lower portions. Upper portions include installing the reflector 202 onto the damper 204 and the damper 204 onto the upper plate 206, and installing a set of upper protection guards and a set of lower protection guards onto a set of upper support members 208.

The purpose of the damper 204 is to provide a controlled flow of hot air coming from within the glass tube 212 to the reflector 202. The flow rate is controlled by the heights and differences thereof between the set of lower damper legs 1002 and the set of upper damper legs 1004. As illustrated in FIG. 10, the set of lower damper legs 1002 is shorter than the set of upper damper legs 1004. This is because hot air rises and a flow opening directly associated and limited by the set of short lower damper legs 1002 builds up a flow pressure to increase the speed of flow to hit the reflector 202 and be projected to the ambient environment surrounding the heater. As clearly shown in FIGS. 10, 11 and 12, the damper 206, the reflector 202 and the upper plate 206 are affixed to each other by fasteners such as screws.

Figure 13:
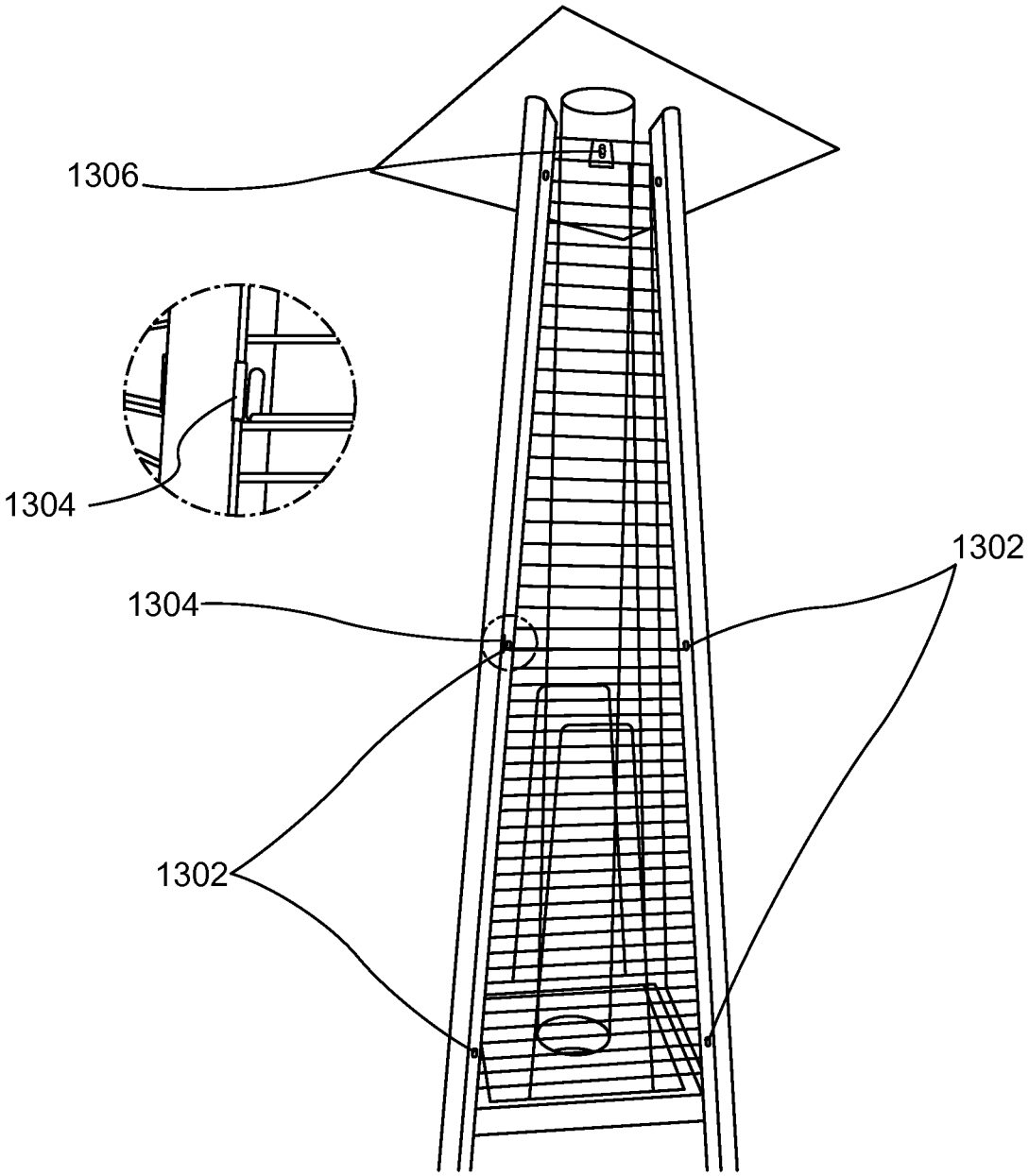
FIG. 13 shows how an upper protection guard is secured along with a lower protection guard.

The upper protection guard 210 and the lower protection guard 214 are installed to the upper support members by way of using a number of hooks 1210 to latch onto a number of elongated oval openings 1302, as shown in FIGS. 12-13. Where the bottom end of the upper protection guard 210 meets the top end of the lower protection guard 214, they are conjoined by inserting any protruding wires into a cylindrical hollow tube 1304. The middle top portion of the upper protection guard 210 is affixed to the upper plate 206 by a retaining clip 1306, as shown in FIG. 13.

In the example given in FIGS. 12-13, the upper protection guards 210 and the lower protection guards 214 are installed outside the upper support members 208 exposing the cylindrical hollow tube 1304, the retaining clip 1306 in plain sight yet hiding the set of hooks 1210 behind the upper support member 208. The installation of the upper support members 208, the cylindrical hollow tube 1304, the retaining clip 1306 could be installed inside the upper support member 208 exposing only the set of hooks 1210 in plain sight, such as the installation shown by way of an example in FIG. 1. The prior installation preference showcases more ornamental features of the heater while the latter installation preference showcases a flush clean look. Either installation preference would serve safeguarding purposes without sacrificing any functionality.

Figure 14:
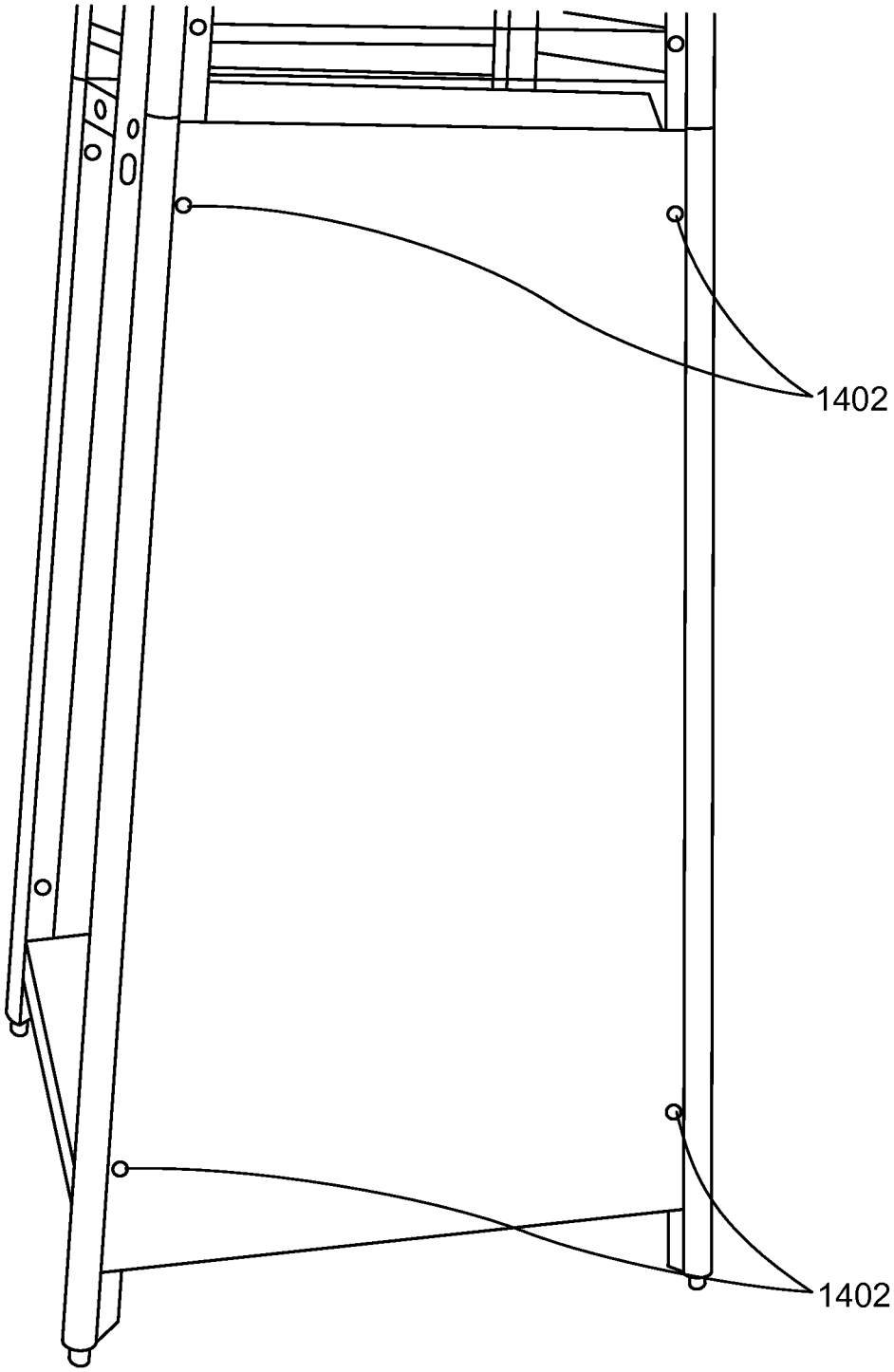
FIG. 14 shows how a side panel is secured to a pair of support members.

The lower portions of the external installation include installing a front door and three side panels. The three panels are each affixed to the lower support member 224 by fasteners 1402 through a set of pre-drill holes as shown in FIG. 14.

Figure 15:
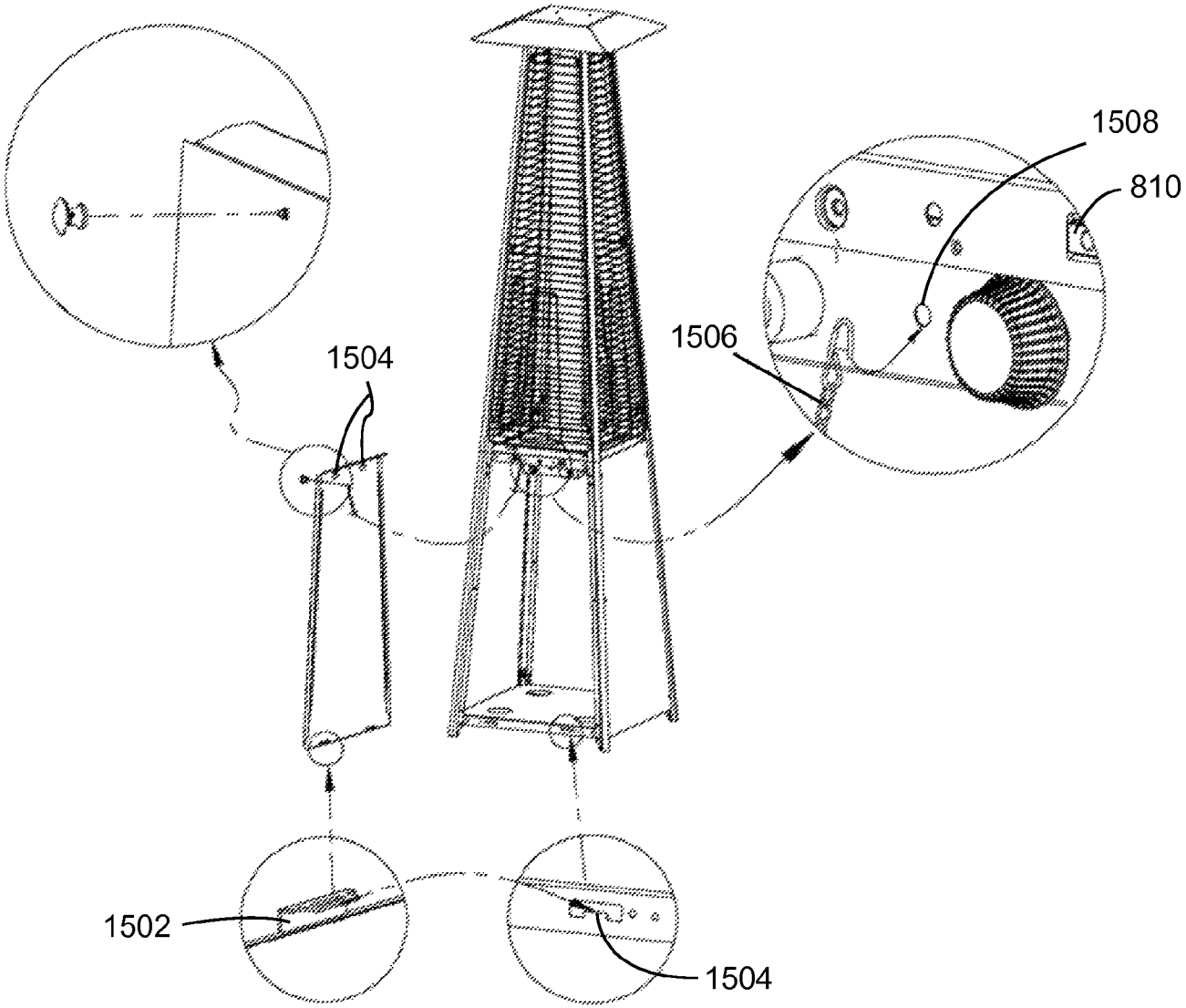
FIG. 15 shows how a front door is secured to the heater.
Figure 16:
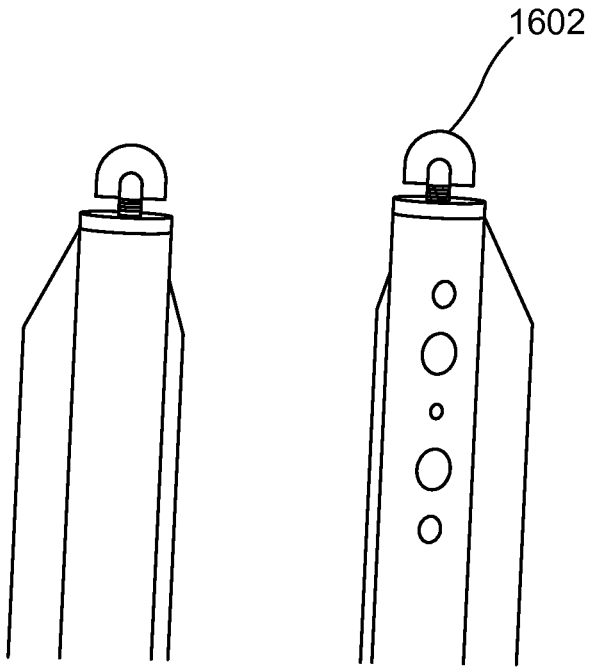
FIG. 16 shows a height adjustable stopper is insertably installed on a lower support member.

The front door has a pair of interior catch brackets 1502 meant to be latched onto a pair of hook brackets 1504 residing on the bottom plate 232 as shown in FIG. 15. A pair of magnets 810 is placed on the side of the middle plate 218. A pair of metallic pieces 1504 is affixed to the back of the front door 226. A chain 1506 is tied to the backside of the door knob on one end and removeably hooked to a retaining hole 1508 of the middle plate 218. These features of the heater are shown by way of an example in FIG. 15. Therefore, the door can be easily removed if an interior chamber of the heater needs to be accessed such as during installation or removal of a LP tank.

Lower ends of the set of lower support members 226 are each installed with a height adjustable stoppers 1602 as shown in FIG. 15 to ensure all four members stand stably on the floor. If the floor is not level for any reason, each stopper can be individually adjusted to suit the situation.

Figure 17:
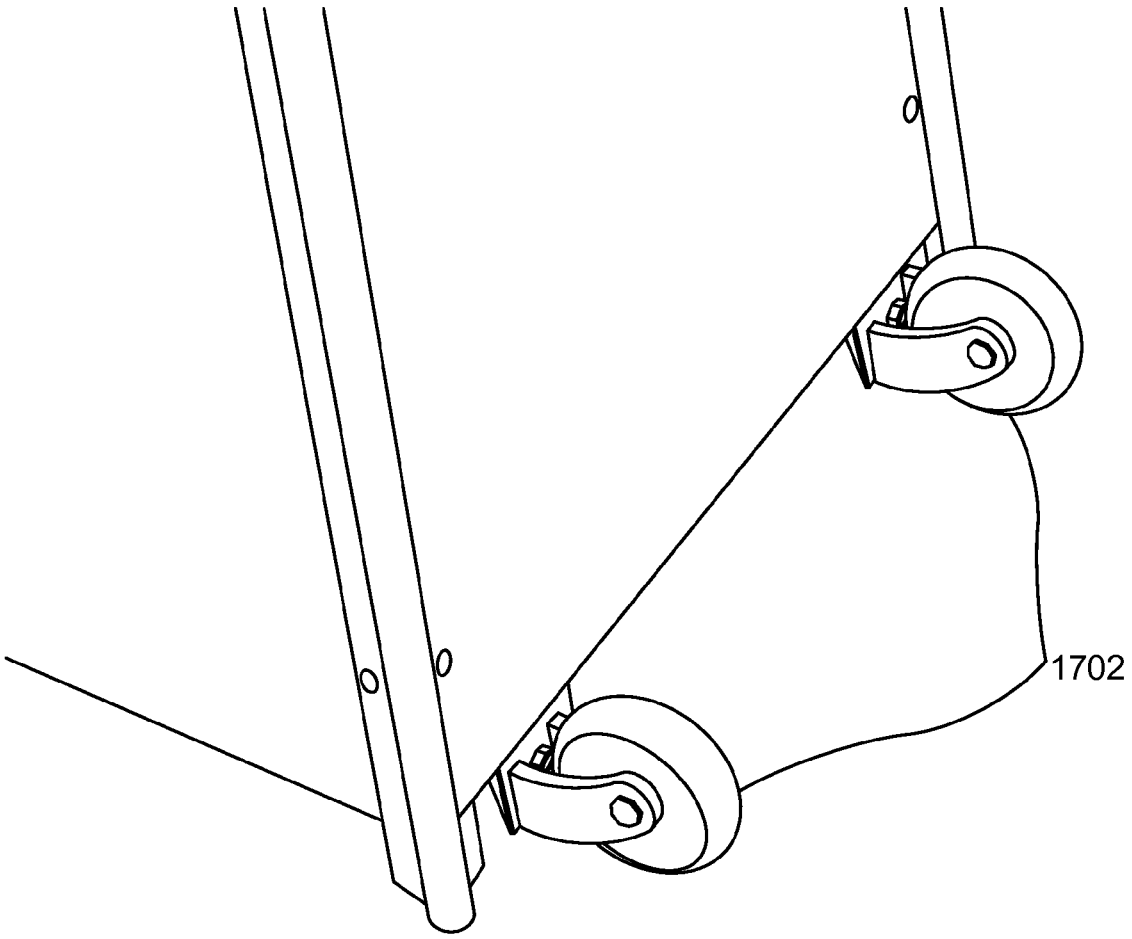
FIG. 17 shows a pair of wheels is installed on a back side of the heater.

Underneath the back panel opposite to the front door is installed a pair of wheels 1702 to the bottom plate 232 as shown by way of an example in FIG. 17. This pair of wheels is suspended in the air when all four height adjustable stoppers 1602 are in full contact with the floor. However, when the heater is tiled backward where all four stoppers are suspended in the air, the pair of wheels 1702 as shown in FIG. 17 is fully engaged and rollable on the floor hence provide heater relocation convenience.

Figure 18:
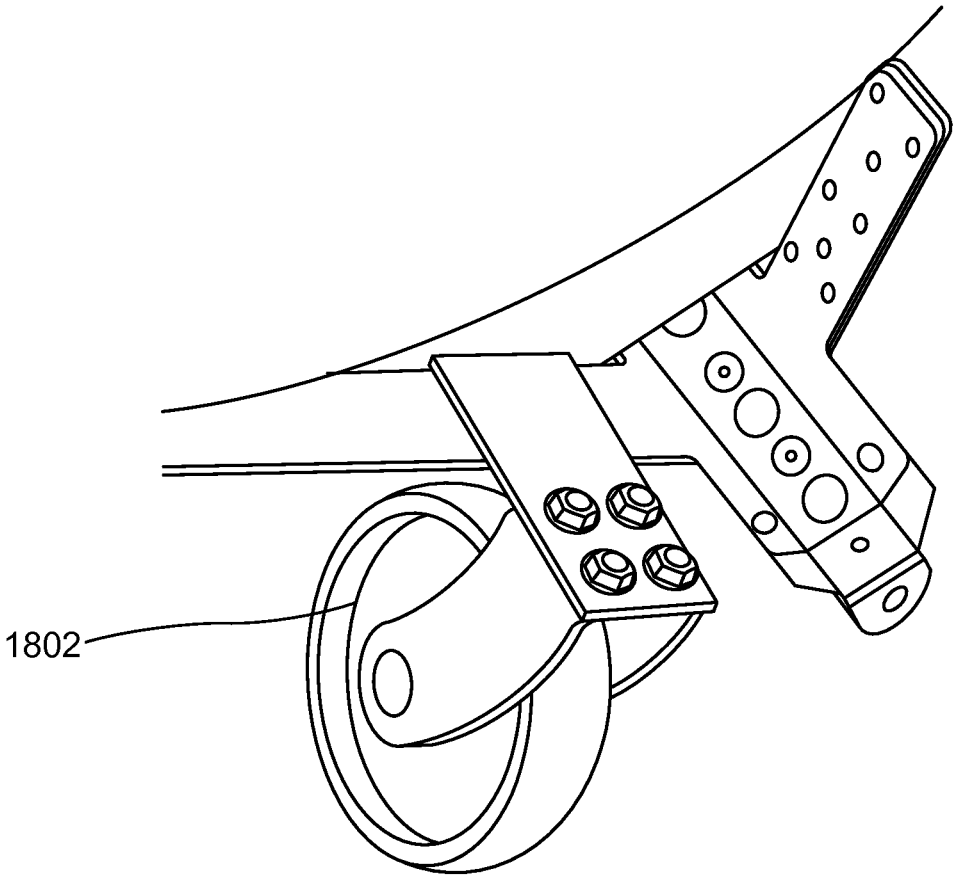
FIG. 18 shows a wheel is secured to a lower plate of the heater.

FIG. 18 shows by way of an example that a wheel is securely attached to an interior side of the bottom plate. In this example, the wheel is welded. However, other fastening methods and fastening means may be used, such as screws, nuts and bolts, etc.

Figure 19:
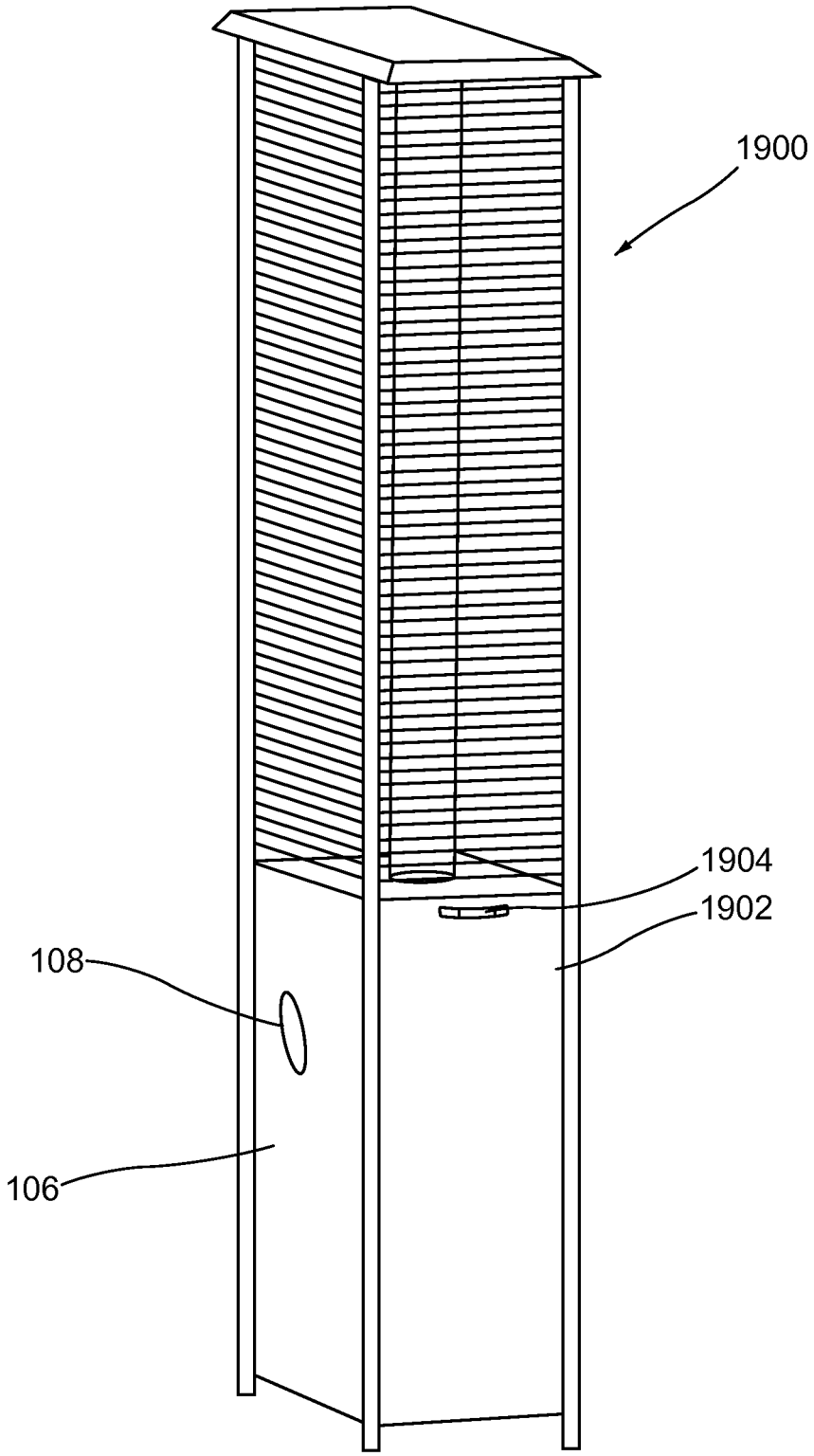
FIG. 19 is a front perspective view of a rectangular shape flame heater in a fully assembled state.

FIG. 19 shows a rectangular shape flame heater. The number of parts in the rectangular shape flame heater is the same as the number of parts in the pyramid shape flame heater. The difference is that the upper plate, middle plate, and lower plate are the same size. The middle plate corner vertical connection tabs and the lower plate corner vertical connection tabs are at right angles respectively with the middle plate and the bottom plate. The upper protection guards, the lower protection guards, the side panels and the front door are rectangular in shape rather than trapezoidal in shape.

The invention claimed is:

1. An outdoor heater, comprising:

an upper plate in an octagonal shape;

a middle plate in an octagonal shape;

a bottom plate in an octagonal shape;

a burner with a flame outlet and a control dial; and a plurality of upper support members correspondingly connected to a plurality of lower support members forming a plurality of sustaining members; and a damper with a set of lower legs situated underneath a separation plate and a set of upper legs situated above the separation plate, wherein the set of lower legs are removably attached to an upper side of the upper plate;

wherein the plurality of sustaining members each has two interior angles and are attached equal distance apart from each other so as to surround and connect to each angle of the upper plate, the middle plate and the bottom plate forming the outdoor heater in substantially a square-based pyramid configuration absent an apex; and wherein the burner is attached to the middle plate.

2. The outdoor heater of claim 1, wherein the upper plate has an upper central hole, the middle plate has a middle central hole and the burner has a burner central hole, and wherein the upper central hole, the middle central hole and the burner central hole all share a same imaginary concentric axis.

3. The outdoor heater of claim 2, further comprising a glass tube installed inside the upper central hole, the middle central hole and the burner central hole sharing the same imaginary concentric axis.

4. The outdoor heater of claim 3, wherein a lower end of the glass tube fully encompassed the flame outlet of the burner so that burning flame resides inside said glass tube, and an upper end of the glass tube is secured by the upper central hole.

5. The outdoor heater of claim 1, further comprising a reflector attached to the set of upper legs of the damper.

6. The outdoor heater of claim 5, wherein the set of lower legs has a length shorter than the set of upper legs so that a flow opening created by the set of lower legs is smaller than a flow opening created by the set of upper legs wherein a flow pressure is higher passing through the flow opening created by the set of lower legs than a flow pressure passing through the flow opening created by the set of upper legs.

7. The outdoor heater of claim 6, wherein the reflector redirects downward to the ambient environment surrounding the heater the hot air arising from the glass tube through the set of flow openings created by the lower legs and the set of flowing openings created by the upper legs.

8. The outdoor heater of claim 1, wherein each of the set of upper support members and each of the set of lower support members has a cross-sectional elongated oval tube budded against a flat wall with a pair of wings projected directly therefrom the flat wall and facing away from the elongated oval tube.

9. The outdoor heater of claim 8, further comprising a pair of brackets located interior to the elongated oval tube and situated around the curve end of the oval tube forming a pair of identical angular tracks opposite in orientation.

10. The outdoor heater of claim 9, further comprising a center-folded curvaceous intermediate connecting piece having a first end snugly inserted into the pair of identical angular tracks of an upper support member and a second end snugly inserted into the pair of identical angular tracks of a lower support member thus makes a connection between the upper support member and the lower support member to form one of said sustaining members.

11. The outdoor heater of claim 10, further comprising a mid corner tab at each corner of the middle plate having a flat wall with two wings identical in shape and substantially similar in size as the flat wall with the pair of wings of the upper and lower support members; wherein each mid corner tab is attached to the connection between the upper support member and the lower support member to reinforce rigidity and increase load bearing capacity at the connection.

12. The outdoor heater of claim 8, further comprising a lower corner tab at each corner of the lower plate having a flat wall with two wings identical in shape and substantially similar in size as the flat wall with the pair of wings of the lower support member; wherein the lower plate is connected to the set of lower support members by attaching the lower corner tab to each lower support member.

13. The outdoor heater of claim 1, further comprising a height adjustable stopper insertably attached to a lower end of each of the set of sustaining members to adjustably ensure each sustaining member is firmly rested on a supporting floor.

14. The outdoor heater of claim 1, further comprising a set of upper protection guards with an upper set of hooks located at the top portion of the upper protection guard attached to an upper set of oval shape openings on two of the set of upper support members by inserting the upper set of hooks into the upper set of oval shape openings.

15. The outdoor heater of claim 14, further comprising a set of lower protection guards with a lower set of hooks located at the top portion of the lower protection guard attached to a lower set of oval shape openings on two of the set of upper support members immediately below the set of upper protection guards by inserting the lower set of hooks into the lower set of oval shape openings.

16. The outdoor heater of claim 15, further comprising a set of hollow cylinders to connect the set of upper protection guards to the set of lower protection guards wherein each hollow cylinder insertably houses a lower pin of each upper protection guard and insertably houses an upper pin of each lower protection guard.

17. The outdoor heater of claim 15, further comprising a retaining clip to secure each upper protection guard to a side of the upper plate.

18. The outdoor heater of claim 1, further comprising a set of side panels each secured to one side of the heater by attaching to two of the set of lower support members forming an interior chamber therein.

19. The outdoor heater of claim 1, further comprising a front door with a pair of interior metallic pieces, a pair of interior catch brackets and a chain, wherein the front door is removably installed on a same side as the control dial of the control box.

20. The outdoor heater of claim 19, further comprising a set of magnets on the middle plate and a retaining hole on the middle plate located on a same side as the control dial of the control box.

21. The outdoor heater of claim 20, further comprising a pair of hook brackets installed on the lower plate on a same side as the control dial of the control box.

22. The outdoor heater of claim 21, wherein the front door is removably installed onto the heater by latching the pair of interior catch brackets to the pair of hook brackets of the lower plate, attached one end of the chain to the retaining hole with a hook and pushing the front door with the pair of metallic pieces toward the pair of magnets until the catch brackets are fully latched onto the hook brackets and the metallic pieces come in contact with the pair of magnets and are magnetically secured by the pair of magnets.

23. The outdoor heater of claim 1, further comprising a set of wheels installed on the lower plate facing a direction opposite to the front door, and the set of wheels are suspended in air when a lower end of each of the set of sustaining members are firmly rested on a floor and the set of wheels engage the floor when the heater is tiled backward and at least two of the sustaining members are lifted off the floor.

24. The outdoor heater of claim 18, further comprising a hole on a side panel and a hole on the lower plate so that a height difference between the holes create a natural ventilation system due to atmospheric differences between the holes.

25. The outdoor heater of claim 1, wherein the middle plate is larger in size than the upper plate and wherein the bottom plate is larger in size than the middle plate.

* * * * *